US009212519B2

(12) United States Patent
Vrooman

(10) Patent No.: US 9,212,519 B2
(45) Date of Patent: Dec. 15, 2015

(54) BOTTOM RAIL LEVEL ADJUSTOR

(71) Applicant: Brooks Vrooman, Mount Horeb, WI (US)

(72) Inventor: Brooks Vrooman, Mount Horeb, WI (US)

(73) Assignee: Lumino, Inc., Madison, WI (US)

( * ) Notice: Subject to any disclaimer, the term of this patent is extended or adjusted under 35 U.S.C. 154(b) by 115 days.

(21) Appl. No.: 14/189,344

(22) Filed: Feb. 25, 2014

(65) Prior Publication Data

US 2015/0240558 A1 Aug. 27, 2015

(51) Int. Cl.

| | |
|---|---|
| ***E06B 9/38*** | (2006.01) |
| ***E06B 9/36*** | (2006.01) |
| *E06B 9/262* | (2006.01) |

(52) U.S. Cl.

CPC ..... *E06B 9/367* (2013.01); *E06B 2009/2625* (2013.01)

(58) Field of Classification Search

USPC ..... 160/173 R, 168.1 R, 178.1 R, 84.04, 160/84.05, 84.06

IPC ..... E06B 2009/2625,2009/2622, 2009/2627

See application file for complete search history.

(56) References Cited

U.S. PATENT DOCUMENTS

| | | | | |
|---|---|---|---|---|
| 3,327,765 | A * | 6/1967 | Strahm et al. | 160/168.1 R |
| 4,557,309 | A * | 12/1985 | Judkins | 160/84.06 |
| 6,119,757 | A | 9/2000 | Judkins et al. | |
| 6,792,997 | B2 * | 9/2004 | Damiano | 160/178.1 R |
| 7,730,926 | B2 * | 6/2010 | Moriya et al. | 160/84.06 |
| 7,766,068 | B2 * | 8/2010 | Andersen | 160/173 R |
| 8,567,474 | B2 | 10/2013 | Lin | |
| 2009/0294076 | A1 * | 12/2009 | McNiel | 160/127 |
| 2012/0312486 | A1 * | 12/2012 | Spray | 160/340 |

FOREIGN PATENT DOCUMENTS

DE 102009008774 A1 * 8/2010

* cited by examiner

*Primary Examiner* — David Purol

(74) *Attorney, Agent, or Firm* — Buchanan Ingersoll & Rooney PC

(57) ABSTRACT

A level adjusting device for the bottom rail of a window covering is disclosed. This device has a housing having a base, a top and a sidewall extending between the base and the top. The top has an opening through which a lift cord passes. The base has a first opening through which a lift cord passes and a second opening. A spindle is positioned within the housing, such that the bottom end of the spindle is positioned over the second opening in the bottom of the housing. That bottom end is configured to receive a tool for turning the spindle. The spindle has a peripheral edge with spaced apart notches that are engaged by a projection extending from the housing. Turning the spindle causes the lift cord to be wound around or unwound from the spindle which shortens or lengthens that lift cord to level the bottom rail.

19 Claims, 7 Drawing Sheets

BOTTOM RAIL LEVEL ADJUSTOR

FIELD OF THE INVENTION

The present invention relates generally to window coverings which have a bottom rail, such as Venetian blinds, pleated blinds, cellular blinds, and some Roman shades.

BACKGROUND OF THE INVENTION

Venetian blinds, pleated blinds, cellular blinds, and some Roman shades have a headrail, a bottom rail, window covering material extending between the headrail and the bottom rail and lift cords extending from the headrail to the bottom rail. The bottom rail may be rectangular and have a height as small as one half inch and as large as two inches. Some bottom rails have a curved front face or a curved bottom. Other bottom rails are cylindrical. Typically, one end of each lift cord is attached to and wound on a spool in the headrail and the opposite end of the lift cord is attached to the bottom rail. The spools on which the lift cords are wound may be on a common shaft that is operated by a pull cord or a cord loop. In cordless blinds there are spring motors which provide the force for winding the spools that contain the lift cords. U.S. Pat. No. 5,482,100 to Kuhar discloses a cordless, balanced Venetian blind or shade with consistent variable force spring motor. This system uses spring motors to balance the weight of the bottom rail and the accumulating window covering material as the window covering is raised or lowered by simply grasping the bottom rail and urging it upwardly or downwardly.

A problem common among window coverings having a bottom rail is balancing of the bottom rail so that it is level when the window covering material is at a fully lowered or partially lowered position. In many window coverings the lift cord extends through a hole in the bottom rail and is held in place by a knot tied in the lift cord. When the window covering is installed the installer can level the bottom rail by changing the location of the knot on selected lift cords. In other window coverings a clamp in provided in the bottom rail for attaching the lift cord to the bottom rail. In this product the installer can lengthen or shorten the lift cord by unclamping, moving and re-clamping the lift cord.

Many window coverings have weights in the bottom rail that can be moved left or right on the bottom rail. Because the lift cords are usually polyester adding weight to or shifting weight on the bottom rail will stretch the lift cord and thus can be used to level the bottom rail. One easy method to level a bottom rail is to use weighted, tape-like strips which are adhered to the bottom rail by the fabricator at appropriate locations. Most frequently, such strips are applied after the window covering has been fabricated and after it has been determined where any imbalance may exist. Another approach for resolving the weight balance issue is disclosed by Colson et al. in U.S. Pat. No. 5,320,154. They teach a weight element that is slidably disposed in the bottom rail and is moved longitudinally along the bottom rail until appropriate balance is achieved. U.S. Pat. No. 6,769,471 to Voss et al. discloses another approach to using weights to level a bottom rail.

While all of these approaches provide methods for achieving a level bottom rail, they suffer from one or more drawbacks with regard to installation and/or use. First, none of these systems are easy for a consumer to use and some require the use of specialized tools. Second the balance of the bottom rail may change after the window covering has been hung because the window covering material or the a cord may have stretched or contracted unevenly along its length causing one end of the bottom rail to be lower than the other end. Should that occur it may be necessary to dismantle the bottom rail and readjust the cord length or the weight and balancing system. Even if the weights on the bottom rail are easily accessible, repositioning those weights to level the bottom rail may be difficult, depending on the skill of the owner or user of the window covering.

Consequently there is a need for a bottom rail which is easy to level, not only at the time of installation but also after the blind has been hung in place for several months or even years.

There is also a need for a bottom rail level adjusting device which can be used on the bottom rails which are currently in use. Indeed, such a bottom rail level adjustor should be capable of being retro-fitted on existing blinds.

SUMMARY OF THE INVENTION

I provide a bottom rail leveling device that has a housing having a base, a top and a sidewall extending between the base and the top. The top has an opening through which a lift cord passes. The base has a first opening through which a lift cord passes and a second opening. A spindle is positioned within the housing, such that the bottom end of the spindle is positioned over the second opening in the bottom of the housing. That bottom end is configured to receive a tool for turning the spindle. The spindle has a peripheral edge with spaced apart notches that are engaged by a projection extending from the housing. Turning the spindle causes the lift cord to be wound around or unwound from the spindle which shortens or lengthens that lift cord to level the bottom rail.

I prefer to provide a cord anchor clip within the housing and adjacent the first opening in the base which is attached to the lift cord.

I prefer to make the housing as two halves connected together by at least one strap. The first half and the second half each containing a portion of the sidewall, the top and the bottom of the housing. I further prefer to provide a socket on one half that receives a pin that extends from the other half to align the halves and hold them together. This housing can be made of plastic with the two halves and strap or straps being molded as a single piece.

Other objects and advantages of my bottom rail level adjusting device will become apparent from certain present preferred embodiments thereof which are shown in the drawings.

DESCRIPTION OF THE PREFERRED EMBODIMENTS

Figure 1:
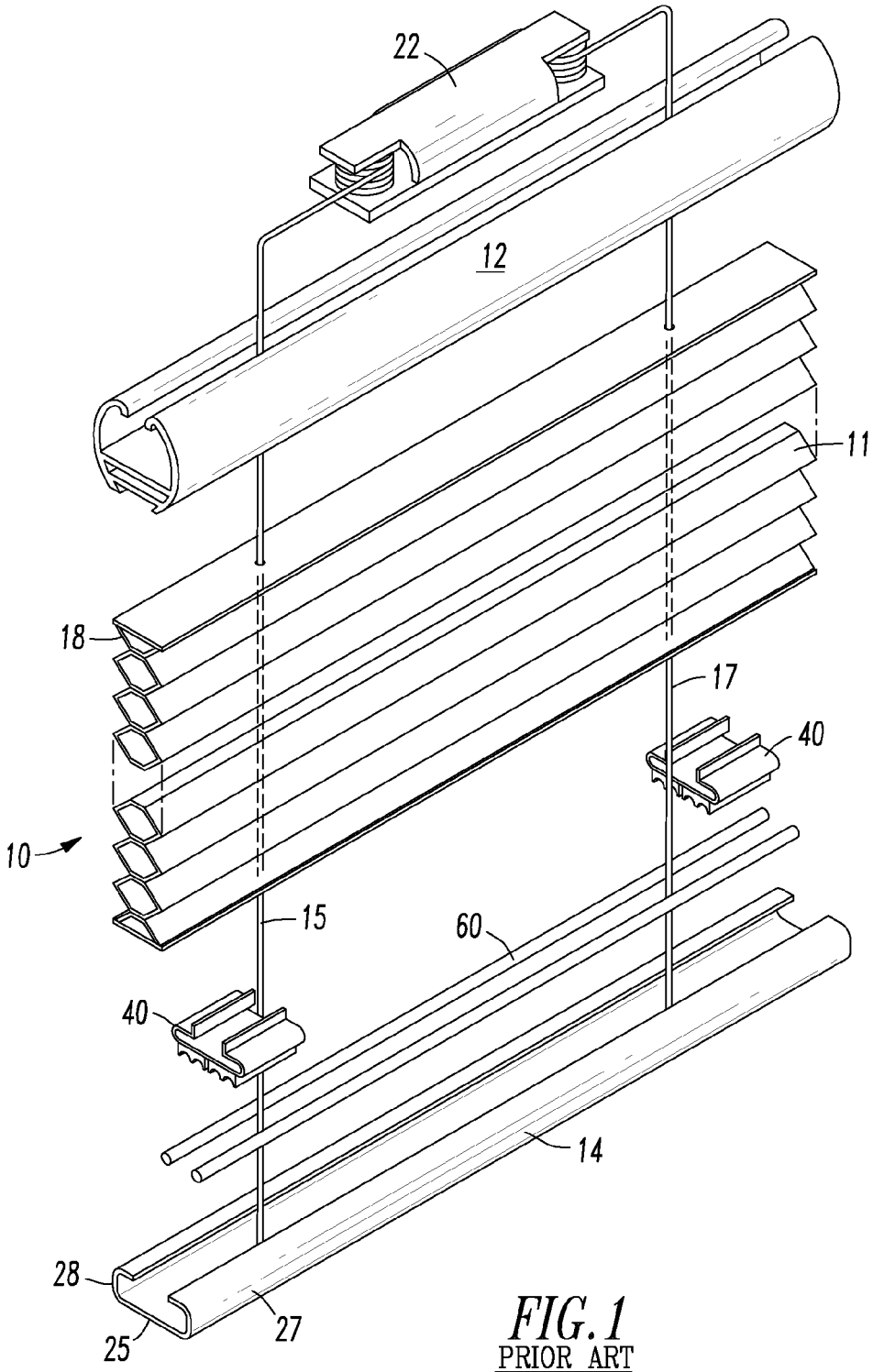
FIG. 1 PRIOR ART
FIG. 1 is an exploded view of a cordless window covering known in the art illustrating the headrail, the window covering material, the bottom rail which has two body members with weights is attached to sockets in the body member.

Referring to a description of FIG. 1, a cordless window blind 10 which is known in the art has a cellular window covering material 11 which is connected between a headrail 12 and a bottom rail 14. Lift cords 15 and 17 pass from spools in the headrail 12 through the various cells 18 of window covering material 11 to the bottom rail 14. The spools on which the cords 15 and 17 are wound are coupled to a spring motor 22 of the type described in U.S. Pat. No. 5,482,100 to Kuhar. At their lower ends, the lift cords are attached to structure (not shown) in the bottom rail which may be any structure known to the art. During fabrication, the length of the cords 15 and 17 is typically adjusted and fixed so that when fully lowered, the bottom rail 14 and head rail 12 will be separated by a predetermined distance to cover at least a portion of a window over which the blind is mounted.

The shape for the bottom rail can be selected from those known to the art and is typically made of from steel or aluminum and are painted an appropriate color for the window covering. Vinyl materials may also be employed and are in common use for lower-priced point applications. In the window blind 10 shown in FIG. 1 the bottom rail has a generally flat bottom portion 25 extending the entire width of the window covering 10 and is bounded on the front and back by C-shaped edges 27 and 28. The depth of the edges 27-28 is sufficient to allow containment of those elements of window covering 10 which are normally captured in the bottom rail and may include weights. Moreover, the C-shaped edges 27-28 create a slot which is narrower than the overall width of bottom rail 14. One function of that slot is the containment of slat (not shown) having a hole for each lift cord and through which the lift cord passes. In this cordless blind 10 body members 40 have a flat bottom and a pair of C-shaped edges adapted to slidingly fit with the interior of edges 27 and 28 of the bottom rail 14. Body members 40 can thus be placed within bottom rail 14 and be retained in the desired position by the fabricator or the user of the window covering. Rods 60 act as weights and are of a length sufficient to be captured within the sockets on the bottom of the two body members 40. The length and number of the rods used could be adjusted depending on the particular window covering. The bottom rail 14 is leveled by moving the rods and perhaps the two body members left or right within the headrail as needed. It may take considerable time and skill to position the rods 60 so that the bottom rail 14 is level when the blind is hung over a window.

Figure 2:
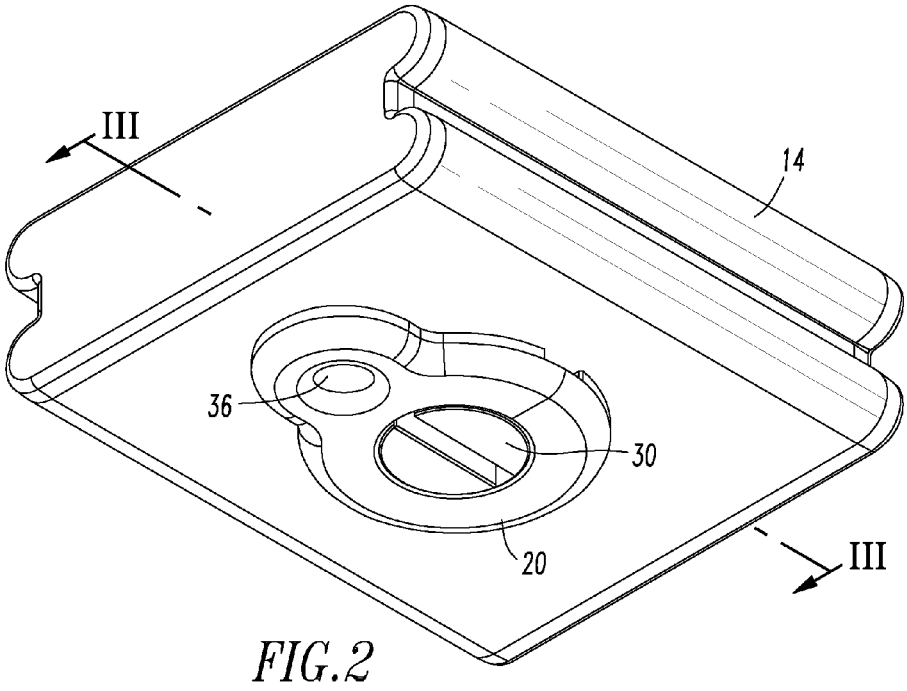
FIG. 2 is a perspective view of a portion of a bottom rail to which a present preferred embodiment of my bottom rail level adjusting device is attached.
Figure 3:
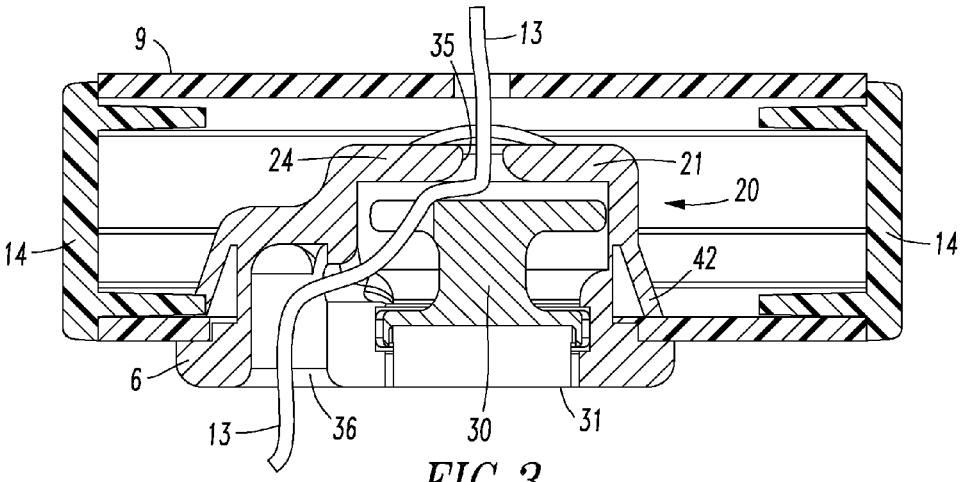
FIG. 3 is a sectional view taken along the line III-III in FIG. 2.
Figure 4:
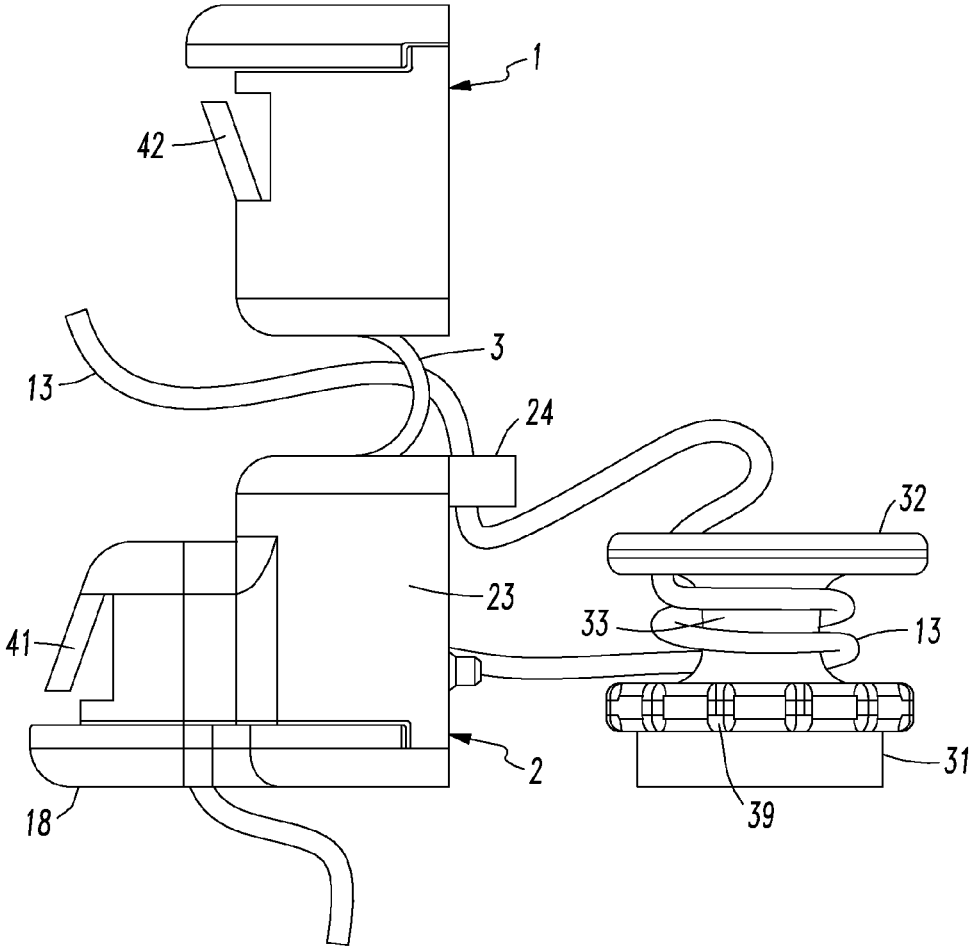
FIG. 4 is an exploded side view of the present preferred embodiment of my bottom rail level adjusting device.
Figure 5:
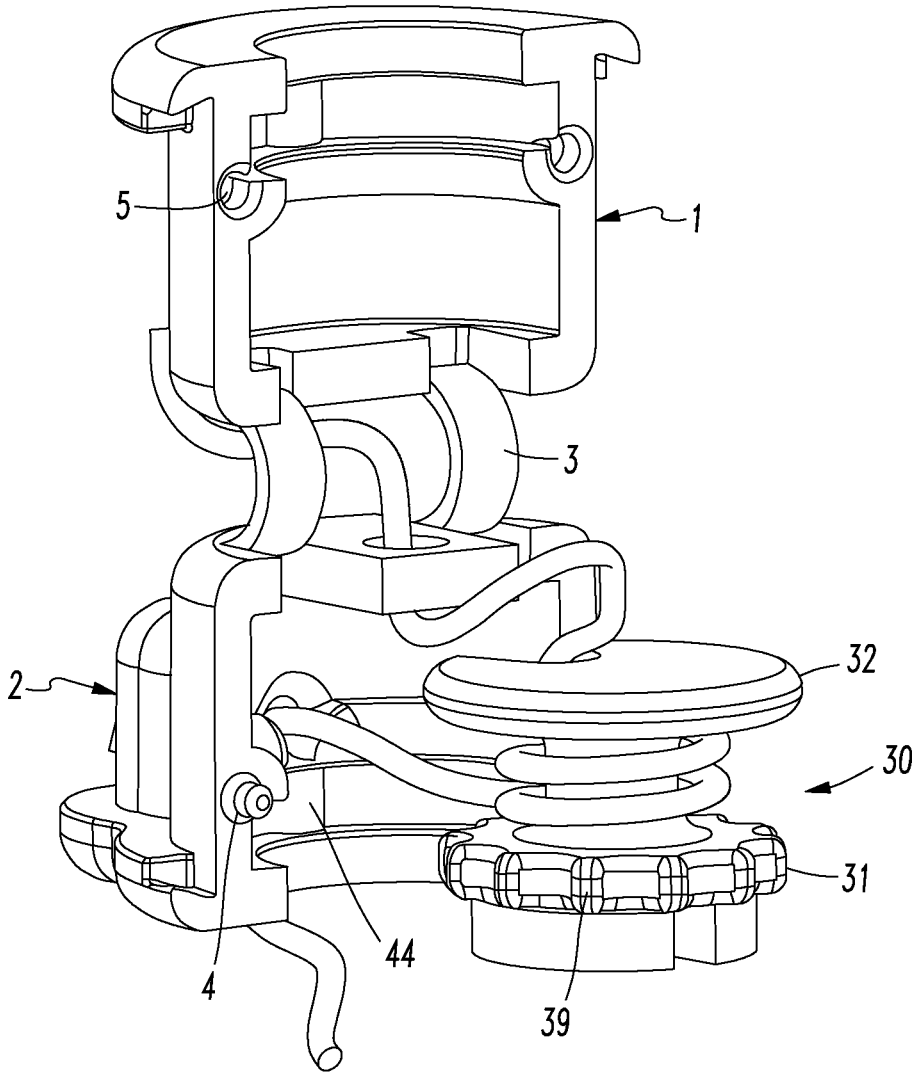
FIG. 5 is a perspective view of the present preferred embodiment of my bottom rail level adjusting device as shown in FIG. 4.
Figure 6:
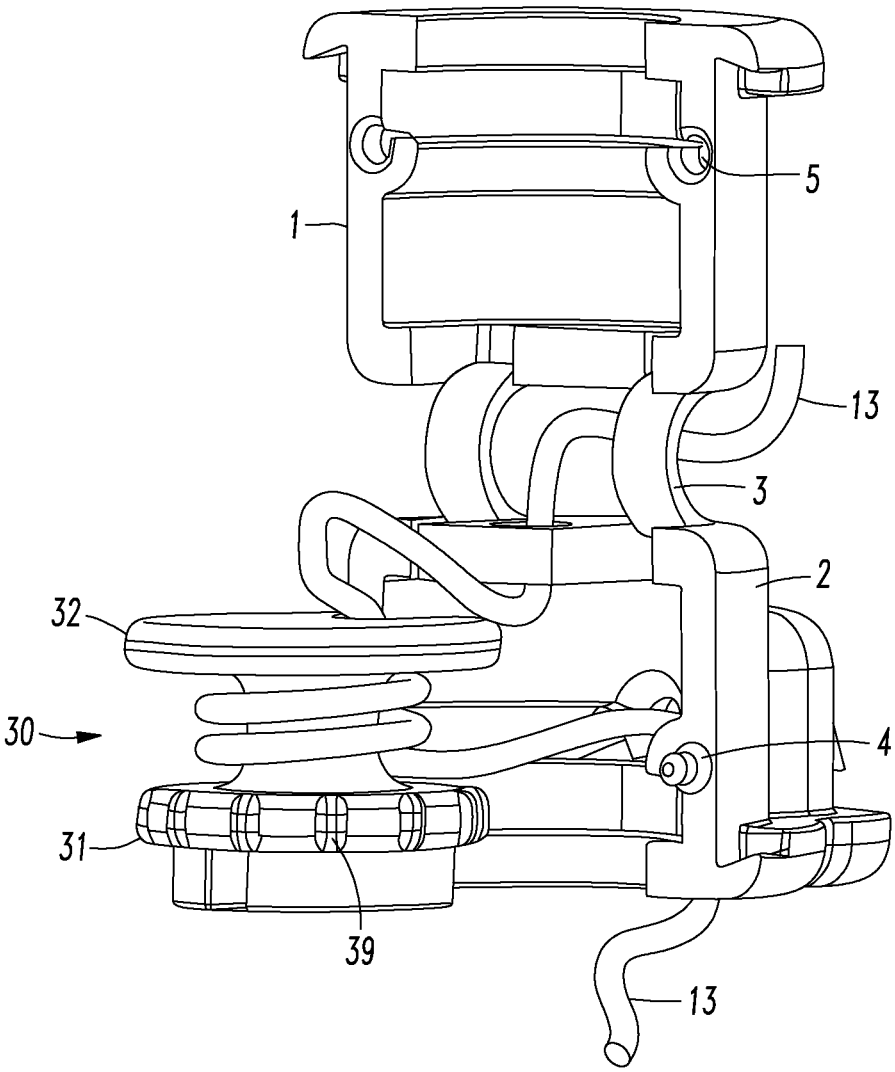
FIG. 6 is another perspective view of the present preferred embodiment of my bottom rail level adjusting device as shown in FIG. 4.
Figure 7:
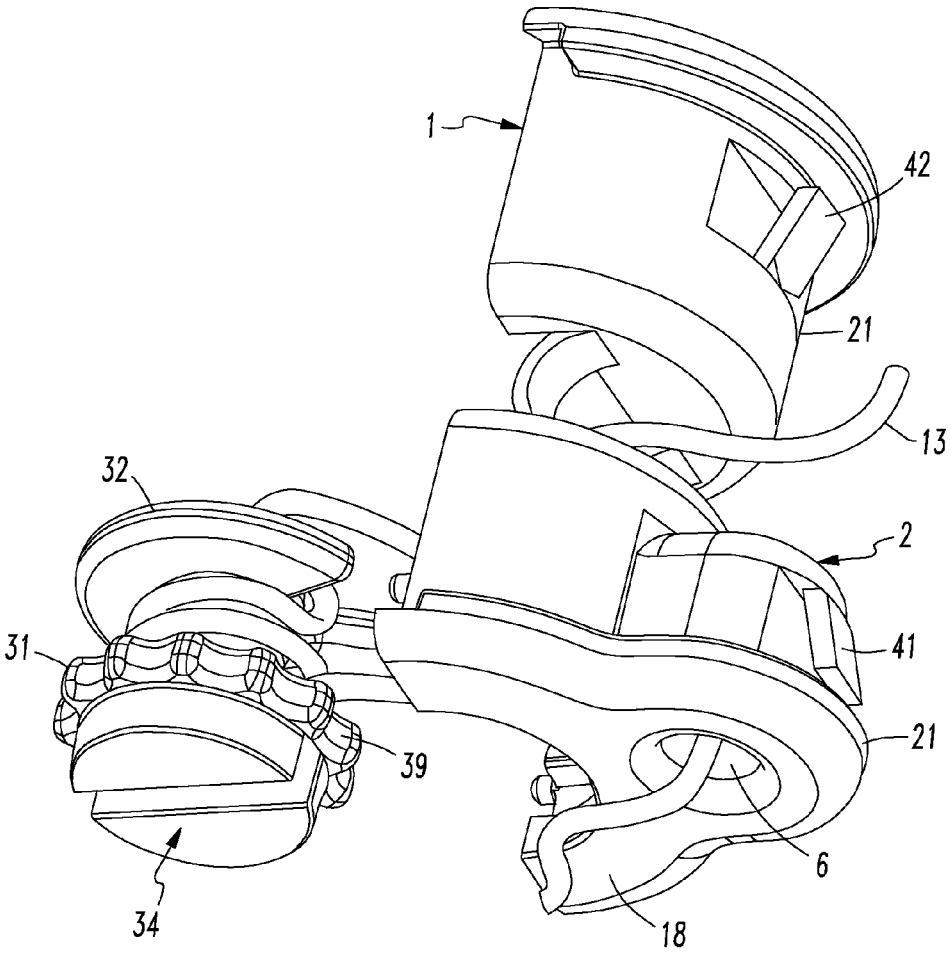
FIG. 7 is a bottom perspective view of the present preferred embodiment of my bottom rail level adjusting device as shown in FIG. 4.
Figure 8:
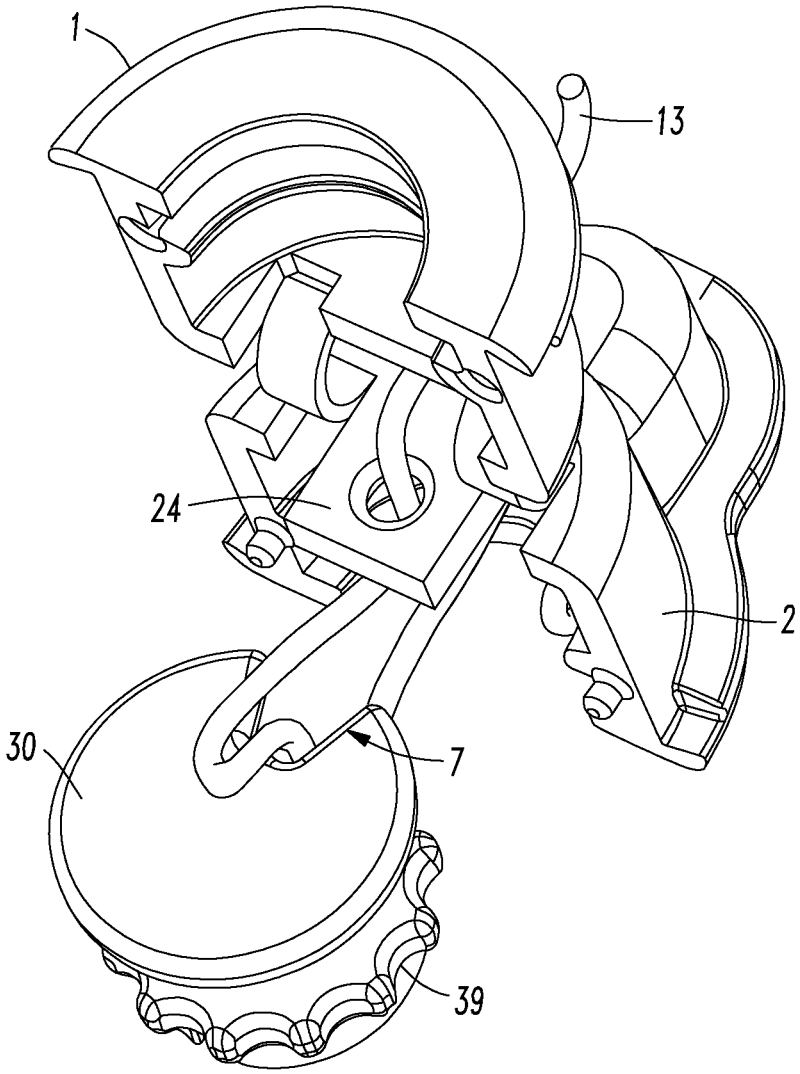
FIG. 8 is a top perspective view of the present preferred embodiment of my bottom rail level adjusting device as shown in FIG. 4.

Referring to FIGS. 2 and 3 I provide a bottom rail level adjustor 20 that can be snap fit into a bottom rail 14. As can be seen most clearly in FIGS. 3 through 8, the bottom rail level adjustor 20 has a housing 21 which consists of a base 18, a top 24 and a sidewall 23 extending between the base and the top. The top 24 has an opening 35 through which a lift cord passes 13. The base 18 has a first opening 36 through which a lift cord 13 passes and a second opening 37. A spindle 30 has a bottom end 31, a top end 32 and a roller 33 on which a lift cord is wound. As best seen in FIG. 3 the spindle 30 is positioned within the housing, such that the bottom end 31 of the spindle is positioned over the second opening 37 in the bottom of the housing. That bottom end 31 has a slot 34 sized to receive a screw driver or other tool for turning the spindle. As seen most clearly in FIG. 5 the bottom end 31 of the spindle 30 has a peripheral edge 38 with spaced apart notches 39. A projection 44 extends from the housing. This projection 44 and the notches 39 are sized so that the spindle can be turned with a screw driver or other tool. Turning the spindle causes the lift cord 13 to be wound around or unwound from the spindle which shortens or lengthens that lift cord to level the bottom rail.

Although I prefer to provide the notches on the peripheral edge of the bottom end 31 of the spindle 30 they could be located on the peripheral edge of the top end 32 of the spindle. Yet another option is to arrange the notches on the top surface of the top end 32 of the spindle and provide the projection that engages those notches on the inside surface of the top 24 of the housing 21. Another alternative is to arrange the notches on the outer surface of the bottom end 31 of the spindle 30 and provide the projection that engages those notches on the inside surface of the base 18 of the housing.

I prefer to make the housing 21 in two halves 1 and 2 connected together by two straps 3. As a result the housing can be molded from plastic as one piece. The first half 1 of the housing contains a pair of sockets 5 that each receive an alignment pin 4 on the second half 2 of the housing 21. The alignment pins are sized and positioned to fit within the sockets such that the two halves 1 and 2 can be snap fit together. Both the housing and the spindle can be made from a plastic such as polyvinyl chloride or polycarbonate.

I also prefer to provide a tab or catch tooth 41 and 42 on the exterior of each half 1, 2 of the housing 21. The catch teeth enable the halves to be snap fit into a bottom rail 14 as shown in FIG. 3.

To install the bottom rail level adjustor 20 on the bottom rail of a window covering the installer routes the lift cord from the headrail, through the window covering material and through a hole in the cover 9 on the bottom rail 14. See FIG. 3. While the two halves 1, 2 of the housing 21 are separated from one another the installer routes the lift cord 13 through the hole in the top 24 of the housing to engage the cord anchor clip 6 and pass through the opening 36 in the base 22 of the housing 21. The anchor clip 6 will hold the end of the lift cord 13 within the housing 21. Next the spindle 30 is positioned so that a notch 7 in the top end 32 of the spindle 30 is aligned with the lift cord and will engage the lift cord when the spindle is turned. Then the two halves 1, 2 of the housing 21 are brought together to close the housing. Finally the level adjusting device 20 is snap fit into the bottom rail. If one end of the bottom rail is lower than the opposite end of the bottom rail the owner or installer simple turns the spindle with a screwdriver to wind a sufficient amount of cord on the spindle to raise that end of the bottom rail until the bottom rail is level. If too much lift cord is collected on the spindle such that this end is now higher than the opposite end then the owner or installer turns the spindle in the opposite direction to unwind some of the lift cord lowering that end.

The bottom rail level adjusting device which has been disclosed can be installed in all or nearly all types of bottom rails in use today. This bottom rail level adjustor can also be retro-fitted on the bottom rail of existing blinds.

Although I have shown and described certain present preferred embodiments of my bottom rail leveling device and window coverings containing this device, my invention is not limited thereto but may be variously embodied within the scope of the following claims.

I claim:

1. A bottom rail level adjusting device comprising:

a housing having a base, a top and a sidewall extending between the base and the top such that the base, top and sidewall define a cavity, the top having an opening through which a lift cord can pass and the base having a first opening through which a lift cord can pass and a second opening;

a spindle positioned within the cavity, the spindle having a top end, a bottom end, the bottom end positioned over the second opening in the bottom of the housing and the bottom end configured to receive a tool for turning the spindle and a peripheral edge having a plurality of spaced apart notches arranged is a generally circular pattern, and a roller connected to and between the top end and the bottom end; and a projection on at least one of the sidewall, the top and the bottom of the housing, the projection positioned to engage the peripheral edge of the spindle and fit into each notch of the plurality of spaced apart notches when the projection is aligned with any selected notch.

2. The bottom rail level adjusting device of claim 1 also comprising at least one snap catch tooth on the housing.

3. The bottom rail level adjusting device of claim 1 also comprising a cord anchor clip on the housing adjacent the first opening in the base.

4. The bottom rail level adjusting device of claim 1 wherein the housing is comprised of a first half and a second half, each half containing a portion of at least one of the sidewall, the top and the bottom of the housing.

5. The bottom rail level adjusting device of claim 4 also comprising at least one strap connected between the first half of the housing and the second half of the housing.

6. The bottom rail level adjusting device of claim 4 wherein the first half of the housing contains a socket and further comprising an alignment pin on the second half of the housing, the alignment pin sized and positioned to fit within the socket.

7. The bottom rail level adjusting device of claim 1 wherein the housing is plastic.

8. The bottom rail level adjusting device of claim 1 wherein the bottom end of the spindle has a slot for receiving the tool for turning the spindle.

9. The bottom rail level adjusting device of claim 1 wherein the top end of the spindle has a notch positioned to engage a lift cord which passes through the through the opening in the top of the housing.

10. An improved window covering of the type having a headrail, a bottom rail, window covering material extending between the headrail and the bottom rail and lift cords extending from the headrail to the bottom rail wherein the improvement comprises a bottom rail level adjusting device attached to the bottom rail, the bottom rail level adjusting device comprising:

a housing having a base, a top and a sidewall extending between the base and the top such that the base, top and sidewall define a cavity, the top having an opening through one of the lift cords passes and the base having a first opening through which that one lift cord passes and a second opening;

a spindle positioned within the cavity, the spindle having a top end, a bottom end, the bottom end positioned over the second opening in the bottom of the housing and the bottom end configured to receive a tool for turning the spindle and a peripheral edge having a plurality of spaced apart notches arranged is a generally circular pattern, and a roller connected to and between the top end and the bottom end; and a projection on at least one of the sidewall, the top and the bottom of the housing, the projection positioned to engage the peripheral edge of the spindle and fit into each notch of the plurality of spaced apart notches when the projection is aligned with any selected notch.

11. The improved window covering of claim 10 also comprising at least one snap catch tooth on the housing which engages the bottom rail.

12. The improved window covering of claim 10 also comprising a cord anchor clip on the housing adjacent the first opening in the base and attached to the lift cord that passes through the opening in the top of the housing.

13. The improved window covering of claim 10 wherein the housing is comprised of a first half and a second half, each half containing a portion of at least one of the sidewall, the top and the bottom of the housing.

14. The improved window covering of claim 13 also comprising at least one strap connected between the first half of the housing and the second half of the housing.

15. The improved window covering of claim 13 wherein the first half of the housing contains a socket and further comprising an alignment pin on the second half of the housing, the alignment pin sized and positioned to fit within the socket.

16. The improved window covering of claim 10 wherein the housing of the bottom rail level adjusting device is plastic.

17. The improved window covering of claim 10 wherein the bottom end of the spindle has a slot for receiving the tool for turning the spindle.

18. The improved window covering of claim 10 wherein the top end of the spindle has a notch positioned to engage a lift cord which passes through the through the opening in the top of the housing.

19. The improved window covering of claim 10 also comprising a weight attached to the bottom rail.

* * * * *